US006749109B2

(12) United States Patent
Hill

(10) Patent No.: US 6,749,109 B2
(45) Date of Patent: Jun. 15, 2004

(54) CLUSTER MAILBOX PROTECTIVE GATE SYSTEM

(76) Inventor: Richard D. Hill, 1620 E. Pickrell Dr., Phoenix, AZ (US) 85042

( * ) Notice: Subject to any disclaimer, the term of this patent is extended or adjusted under 35 U.S.C. 154(b) by 0 days.

(21) Appl. No.: 10/337,570

(22) Filed: Jan. 7, 2003

(65) Prior Publication Data

US 2003/0127504 A1 Jul. 10, 2003

Related U.S. Application Data

(60) Provisional application No. 60/347,354, filed on Jan. 9, 2002, and provisional application No. 60/394,693, filed on Jul. 8, 2002.

(51) Int. Cl.[7] ..... B65D 91/00
(52) U.S. Cl. ..... 232/25; 232/24
(58) Field of Search ..... 232/24, 25, 45, 232/43.1; 211/10; 109/67, 68; 49/68

(56) References Cited

U.S. PATENT DOCUMENTS 618,846 A * 2/1899 Crowder ..... 232/25
693,770 A * 2/1902 Wright et al. ..... 232/17
1,611,386 A * 12/1926 Stanley ..... 49/263
1,817,191 A * 8/1931 Harmony ..... 232/24
4,953,327 A * 9/1990 Cohodar ..... 52/36.1
5,103,659 A * 4/1992 Benefield, Sr. ..... 70/94
5,267,688 A * 12/1993 Benefield ..... 232/17
5,820,018 A * 10/1998 Stacy ..... 232/24
5,820,019 A * 10/1998 Spitale ..... 232/25
6,247,641 B1 * 6/2001 Noblet et al. ..... 232/17
6,328,205 B1 * 12/2001 Noblet et al. ..... 232/17

* cited by examiner

*Primary Examiner*—Robert J. Sandy
*Assistant Examiner*—William L Miller
(74) *Attorney, Agent, or Firm*—Martin L. Stoneman

(57) ABSTRACT

A system for protecting cluster mailboxes such as neighborhood delivery and collection box units (NDCBU's) and Cluster Box Units (CBU's)from vandalism or theft of the mail. A custom-fit protective gate is built and installed around the mail carrier access doors of a cluster mailbox. The protective gate is built to aesthetically blend in with the neighborhood environment and may include decorative accoutrements such as decorative screening. Further, the system provides a means to install USPTO locks thereby providing uniform access by mail carriers. Even further, the system provides for double nesting doors to access a flat wall unit collection box, such that users may have secured access to individual mailboxes and a mail person may have secured master access to all mailboxes.

15 Claims, 12 Drawing Sheets

CLUSTER MAILBOX PROTECTIVE GATE SYSTEM

CROSS-REFERENCE TO RELATED APPLICATION

The present application is related to applicant's prior U.S. Provisional Application No. 60/347,354, filed Jan. 9, 2002 entitled "CLUSTER MAILBOX PROTECTIVE ENCLOSURE SYSTEM", and, Provisional Application No. 60/394,693, filed Jul. 8, 2002, entitled "CLUSTER MAILBOX PROTECTIVE ENCLOSURE SYSTEM", the contents of which are herein incorporated by reference and are not admitted to be prior art with respect to the present invention by their mention in this cross-reference section.

BACKGROUND

This invention relates to providing a system for protecting mailboxes, such as neighborhood delivery and collection box units (NDCBU's) and Cluster Box Units (CBU's). Neighborhood delivery and collection box units (NDCBUs) and cluster box units (CBUs), all herein further referred to as cluster mailboxes, are examples of centralized mail delivery, also known as central point delivery. The conveniently located units provide for the delivery and collection of mail. The delivery compartments are individually locked and large enough to hold magazines, merchandise samples, and up to several days accumulation of mail. Outgoing mail is typically deposited in a separate designated compartment. In many areas, parcel lockers are also installed alongside cluster mailboxes to save the customer trips to the post office to pick up packages. With this service, customers enjoy greater mail security and convenience.

Typically, cluster mailboxes are freestanding, pedestal-mounted mail boxes containing, (e.g., 8, 12, 13, or 16, typically) individually locked mailboxes and parcel compartments. These cluster mailboxes typically have front mailbox compartments and single (or occasionally multiple) rear access doors that are locked with a Unites States Postal Service (herein referred to as USPO) keyed lock and allow access to all the mailbox compartments through the one rear door. Installations can be modified to blend with any community decor. A concrete slab normally secures such cluster mailboxes. The Unites States Postal Service has specific requirements for such installations. For example, Postal installed minimum-sized slabs are four feet wide and five feet front to back (4'×5') in 12" deep concrete. This size slab will serve approximately eleven customers. One adds about three feet per about sixteen mailboxes (deliveries). For example, a 10'×5' slab will service approximately forty-five deliveries.

Apartments and commercial buildings are often served by cluster mailboxes installed within a wall of the structure. This type of cluster mailbox typically provides front access doors that are locked with one or more USPO keyed locks and allow access to all the mailbox compartments through one or more front access doors.

Cluster mailboxes such as those described above provide delivery and collection services to a number of residences from a centrally located installation. However, they also provide thieves with a central location for theft of the mail; and this has become a problem. Rural area mailboxes are vulnerable to vandalism because they are usually isolated, located on public thoroughfares, and frequently not visible to the box owners from their homes. City residential mailboxes are vandalized to a lesser degree, but the problem persists. Vandals need only break the single rear Postman's access (or front or both) door lock on a cluster mailbox to gain access to all the individual mailboxes.

A system to prevent such theft of the mail and still allow easy access by Postal Employees would be of great benefit.

OBJECTS OF THE INVENTION

A primary object and feature of the present invention is to provide a protective gate system for restricting access and preventing theft from the rear (postman's access) door of a cluster mailbox.

It is a further object and feature of the present invention to provide a protective gate system for restricting access and preventing theft from the front (users access) door of a cluster mailbox.

It is a further object and feature of the present invention to provide such a system that is custom-made to fit each cluster mailbox or a set of such cluster mailboxes.

It is a further object and feature of the present invention to provide such a system that blends in with the community decor.

It is yet a further object and feature of the present invention to provide such a system that may be securely attached to the concrete slab, which normally secures such cluster mailboxes.

It is yet a further object and feature of the present invention to provide such a system that may be securely attached to the structure of a building especially having wall mounted cluster mailboxes.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a protective gate system for a cluster mailbox, having at least one postman's access door and a plurality of individual mailboxes, comprising, in combination: at least one gate structured and arranged to protect entry to the at least one postman's access door; and, at least one support to support such gate; wherein such at least one gate comprises at least one gate frame having at least one gate door comprising at least one gate lock; wherein such at least one gate frame is structured and arranged to frame the at least one postman's access door; wherein such at least one gate door is adapted to permit entry to the at least one postman's access door; and, wherein such at least one gate lock is adapted to lock such at least one gate door; and wherein the at least one postman's access door is protected and may be selectively accessed by unlocking such at least one gate lock. Moreover, it provides such a protective gate system wherein such at least one gate door comprises at least one gate door hinge. Additionally, it provides such a protective gate system wherein such at least one gate door comprises at least one screen portion. Also, it provides such a protective gate system wherein such at least one screen portion comprises at least one decorative screen to decorate such at least one screen portion. In addition, it provides such a protective gated gate system wherein such at least one lock comprises at least one United States Postal Lock.

In accordance with another preferred embodiment hereof, this invention provides a protective gate system for at least one cluster mailbox having a first side comprising at least one postman's access door and a second side comprising a plurality of individual mailboxes, comprising, in combination: at least one gated structured and arranged to protect entry to the at least one postman's access door and the plurality of individual mailboxes; and at least one support to support such at least one gate; wherein such at least one gate comprises at least one first gate frame having at least one first gate door comprising at least one first gate lock; wherein such at least one gate comprises at least one second gate frame having at least one second gate door comprising at least one second gate lock; wherein such at least one first gate frame is structured and arranged to frame the at least one postman's access door; wherein such at least one second gate frame is structured and arranged to frame the plurality of individual mailboxes; wherein such at least one first gate door is adapted to permit entry to the at least one postman's access door; wherein such at least one second gate door is adapted to permit entry to the plurality of individual mailboxes; wherein such at least one first gate lock is adapted to lock such at least one first gate door; wherein such at least one second gate lock is adapted to lock such at least one second gate door; wherein the at least one postman's access door is protected and may be selectively accessed by unlocking such at least one first gate lock; and, wherein the plurality of individual mailboxes are protected and may be selectively accessed by unlocking such at least one second gate lock. And, it provides such a protective gate system wherein: such at least one first gate door comprises at least one first gate door hinge; and such at least one second gate door comprises at least one second gate door hinge.

Further, it provides such a protective gate system wherein such at least one first gate door comprises at least one screen portion. Even further, it provides such a protective gate system wherein such at least one second gate door comprises at least one screen portion. Moreover, it provides such a protective gate system wherein such at least one second gate door comprises at least one screen portion.

Additionally, it provides such a protective gate system wherein such at least one screen portion comprises at least one decorative screen to decorate such at least one screen portion. Also, it provides such a protective gate system wherein such at least one first lock comprises at least one United States Postal Lock. In addition, it provides such a protective gate system wherein such at least one screen portion comprises 9-guage expanded metal.

In accordance with yet another preferred embodiment hereof, this invention provides a protective gate system for a cluster mailbox, having only one accessible side, comprising at least one postman's access door and at least one mailbox located on the accessible side, comprising, in combination: at least one gate structured and arranged to protect entry to the at least one postman's access door and the plurality of individual mailboxes; and at least one support to support such at least one gate; wherein such at least one gate comprises at least one first gate frame having at least one first gate door comprising at least one first gate lock; wherein such at least one gate comprises at least one second gate frame having at least one second gate door comprising at least one second gate lock; wherein such at least one second gate frame is nested within such at least one first gate frame; wherein such at least one first gate frame is structured and arranged to frame the at least one postman's access door; wherein such at least one second gate frame is structured and arranged to frame the plurality of individual mailboxes; wherein such at least one first gate door is adapted to permit entry to the at least one postman's access door; wherein such at least one second gate door is adapted to permit entry to the plurality of individual mailboxes; wherein such at least one first gate lock is adapted to lock such at least one first gate door; wherein such at least one second gate lock is adapted to lock such at least one second gate door; wherein the at least one postman's access door is protected and may be selectively accessed by unlocking such at least one first gate lock; and, wherein the plurality of individual mailboxes are protected and may be selectively accessed by unlocking such at least one second gate lock.

Furthermore, it provides such a protective gate system wherein: such at least one first gate door comprises at least one first gate door hinge; and such at least one second gate door comprises at least one second gate door hinge. Further, it provides such a protective gate system wherein such at least one second gate door comprises at least one screen portion. Even further, it provides such a protective gate system wherein such at least one screen portion comprises at least one decorative screen to decorate such at least one screen portion. Still further, it provides such a protective gate system wherein such at least one first lock comprises at least one United States Postal Lock. In addition, it provides such a protective gate system wherein such at least one screen portion comprises 9-guage expanded metal. Even further, it provides such a protective gate system wherein the accessible side is flush within a mounting wall and wherein such at least one first gate frame comprises attachment tabs adapted to attach such at least one first gate frame to the mounting wall.

DETAILED DESCRIPTION OF A PREFERRED EMBODIMENT OF THE INVENTION

Figure 1:
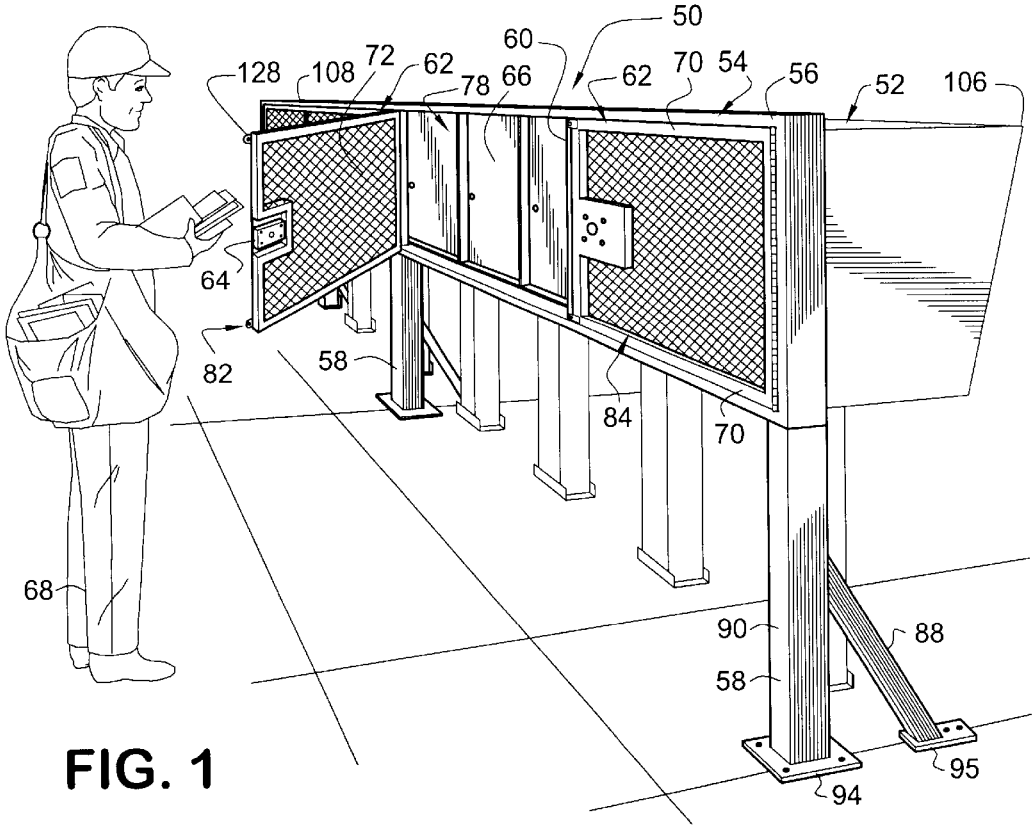
FIG. 1 is a perspective view of the cluster mailbox protective gate system according to a preferred embodiment of the present invention.

Reference is now made to the drawings. FIG. 1 is a perspective view of the cluster mailbox protective gate system 50 according to a preferred embodiment of the present invention. In the illustrated embodiment, a cluster mailbox 52 is shown with a protective gate 54 attached to it. Preferably, the protective gate 54 comprises a sturdy exterior frame 56 supported by one or more posts 58 (embodying herein at least one support to support such gate). Preferably, exterior frame 56 comprises one inch by three inch hollow steel tubing, further comprising interior posts 60, preferably three-quarter-inch by one and one-half inch hollow steel, further comprising one or more hinged doors 62, as shown (embodying herein wherein such at least one gate door comprises at least one gate door hinge). Preferably, hinged doors 62 comprise a locking mechanism 64 (the above arrangement embodies herein wherein such at least one gate lock is adapted to lock such at least one gate door). The above described arrangement embodies herein wherein such at least one gate comprises at least one gate frame having at least one gate door comprising at least one gate lock. Under appropriate circumstances, other materials and dimensions may suffice, such as, for example, aluminum or strengthened plastics.

Protective gate 54 preferably covers and protects the rear 78 of the cluster mailbox 52, including the rear doors 66 (also referred to herein as the postman's access door), as shown (this arrangement embodies herein at least one gate structured and arranged to protect entry to the at least one postman's access door). The rear doors 66 of the cluster mailbox 52 are the most common and vulnerable place where a break-in occurs to the cluster mailbox 52. Preferably, the entire rear door(s) 66 of the cluster mailbox 52 are covered by the exterior frame 56 (embodying herein wherein such at least one gate frame is structured and arranged to frame the at least one postman's access door) and the protective gate 54, as shown. Preferably, a mail-delivery-person 68 may easily access the cluster mailbox 52 by unlocking the hinged doors 62 (embodying herein wherein such at least one gate door is adapted to permit entry to the at least one postman's access door) and unlocking, then accessing, the rear doors 66 of the cluster mailbox 52 (embodying herein wherein the at least one postman's access door is protected and may be selectively accessed by unlocking such at least one gate lock).

Figure 2:
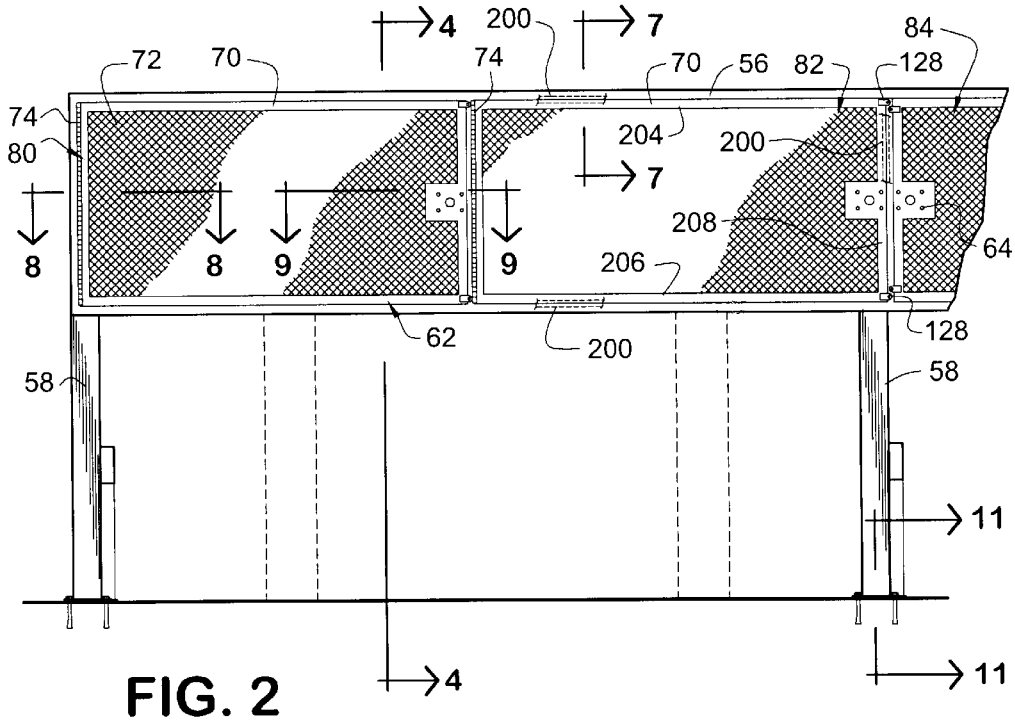
FIG. 2 is a front facing view of the cluster mailbox protective gate system according to a preferred embodiment of the present invention.

FIG. 2 is a front facing view of the cluster mailbox protective gate system according to a preferred embodiment of the present invention. FIG. 2 illustrates a preferred arrangement of the hinged doors 62 of the protective gate 54. Preferably, the hinged doors 62 are made of metal, preferably comprising an outer frame 70, preferably one-inch square tubular steel. Preferably, there is metal screening 72 within the frame 70 (embodying herein wherein such at least one gate door comprises at least one screen portion), preferably, ¾-inch 9-guage expanded metal screen (embodying herein wherein such at least one screen portion comprises 9-guage expanded metal). Under appropriate circumstances, other materials may suffice. The hinged doors 62 are preferably attached to the outer frame 70 by a hinge 74, preferably a continuous hinge, as shown. Preferably, hinge 74 is a stainless steel hinge preferably type-304 stainless steel. Under appropriate circumstances, other types of hinges and materials may suffice. Preferably, the metal screening 72 is welded to the steel outer frame 70, preferably about every inch around the perimeter of the metal screening 72, in well-known ways. Preferably, the hinge 74 is attached, preferably by welding, to both the outer frame 70 and the exterior frame 56, as shown. Under appropriate circumstances, other attachment arrangements may suffice.

FIG. 1 and FIG. 2 also illustrate preferred arrangements of the hinged doors 62, for example, when used as a single door 80 or in combination, such as two doors 82 and 84, as shown. Use of two doors 82 and 84 is preferable when multiple rear doors 66 of the cluster mailbox 52 are covered, as shown, however, under appropriate circumstances, other door arrangements may suffice.

Figure 3:
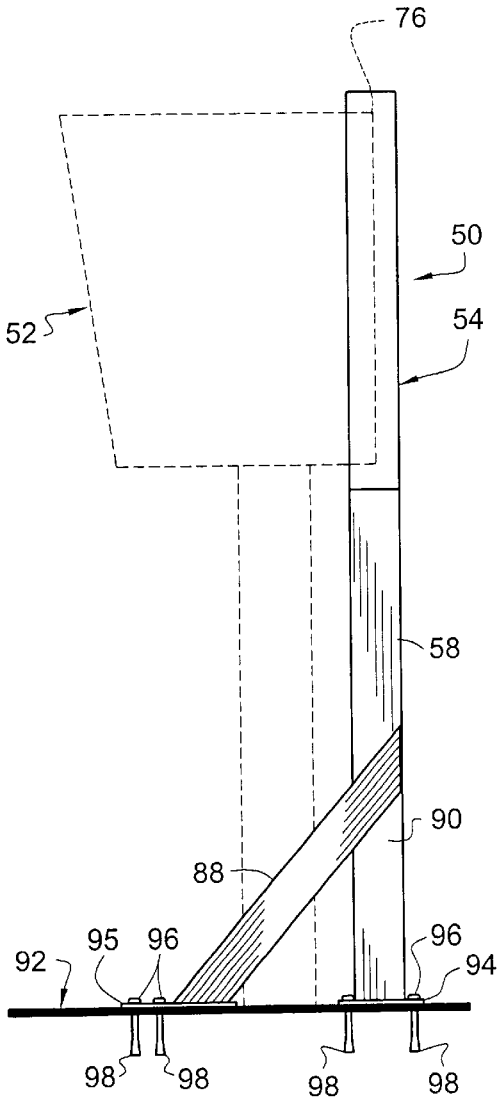
FIG. 3 is a side view of the cluster mailbox protective gate system according to a preferred embodiment of the present invention.
Figure 4:
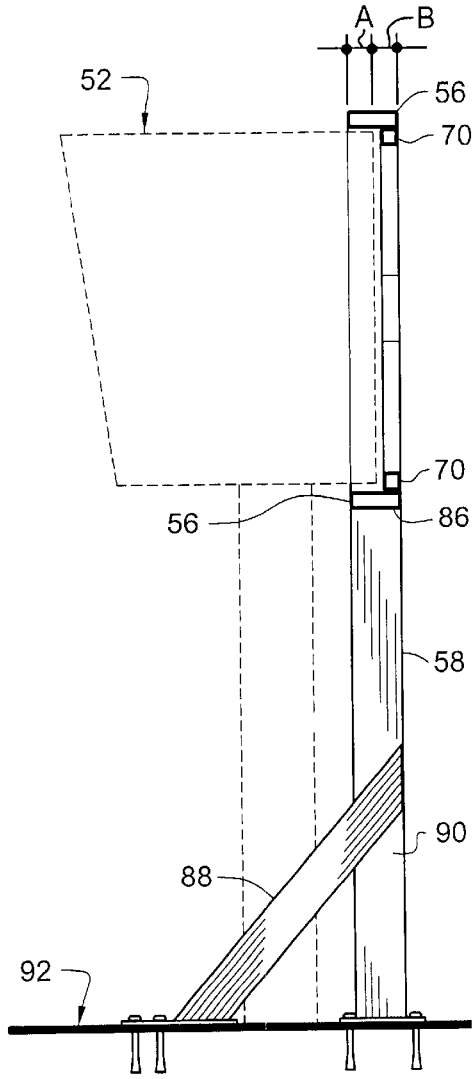
FIG. 4 is a sectional view through section 4—4 of FIG. 2.

FIG. 3 is a side view of the cluster mailbox protective gate system 50 according to a preferred embodiment of the present invention. FIG. 4 is a sectional view through section 4—4 of FIG. 2. FIG. 3 and FIG. 4 further illustrate the preferred positioning of the protective gate 54 over and adjacent the cluster mailbox 52. Preferably, the protective gate 54 is positioned such that the cluster mailbox 52 is approximately two inches inset within the protective gate 54, as shown. Dimension A in FIG. 4 would preferably be about two inches based on an overall dimension of the exterior frame 56 of about three inches (also see FIG. 7). The exterior frame 56 is preferably one inch by three inch hollow steel tubing, as shown and illustrated in FIG. 4. Under appropriate circumstances, other materials and dimensions may suffice. Also illustrated is post 58.

Preferably, post 58 extends from the bottom 86 of the protective gate 54, as shown. Preferably, post 58 is weldably attached to the protective gate 54 positioned as shown. In addition, the post 58 preferably has an additional support member 88 extending from the lower end 90 of the post 58 to the support surface 92, preferably at an angle of about 45 degrees, as shown. The above arrangement embodies herein at least one support to support such at least one gate. Preferably, the support member 88 is weldably attached to post 58, positioned as shown. Under appropriate circumstances, other attachment arrangements may suffice. Preferably, the support surface 92 is a concrete slab, preferably on or in the ground. The post 58 is preferably three inch by three inch hollow metal tubing, preferably steel, preferably primed and painted steel, and is preferably secured to the support surface 92 utilizing a bottom base plate 94, as shown. Under appropriate circumstances, other arrangements may suffice. Preferably, bottom base plate 94 is four inches wide by four inches long, preferably steel, preferably one-half-inch thick steel metal plate. Preferably, bottom base plate 94 is secured to the support surface utilizing concrete lag bolts 96 inserted into expanding shields 98, as shown. In addition, additional support member 88 extending from the lower end 90 is preferably secured to the support surface 92 utilizing a bottom base plate 95, as shown. Preferably, bottom base plate 95 is about two inches wide by four inches long, is preferably steel, preferably, one-half-inch thick steel metal plate. Such securing methods of a base plate to concrete slabs are well known and those knowledgeable in such art may choose, under appropriate circumstances, to use other arrangements.

Figure 5:
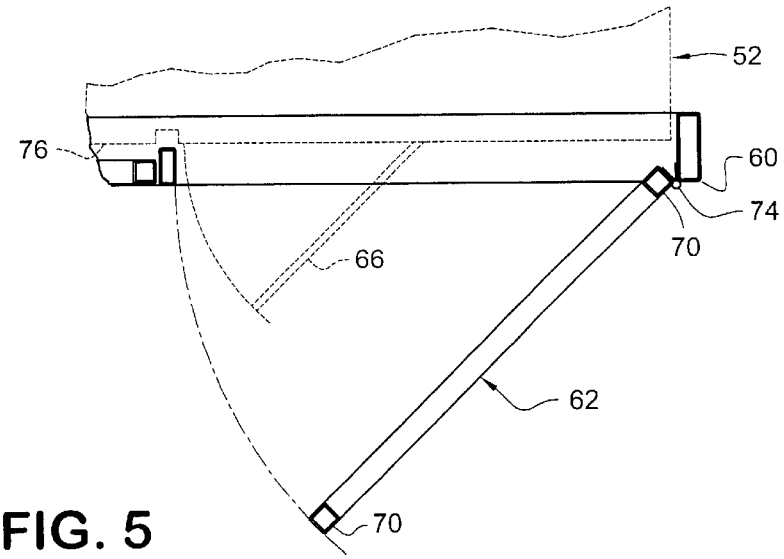
FIG. 5 is a top view of an access door of the cluster mailbox protective gate system according to a preferred embodiment of the present invention.

FIG. 5 is a top view of an access door of the cluster mailbox protective gate system according to a preferred embodiment of the present invention. FIG. 5 illustrates the relative positions of the preferred positioning of the protective gate 54 over and adjacent the cluster mailbox 52 as well as the positioning of both the hinged doors 62 and rear doors 66.

Figure 6:
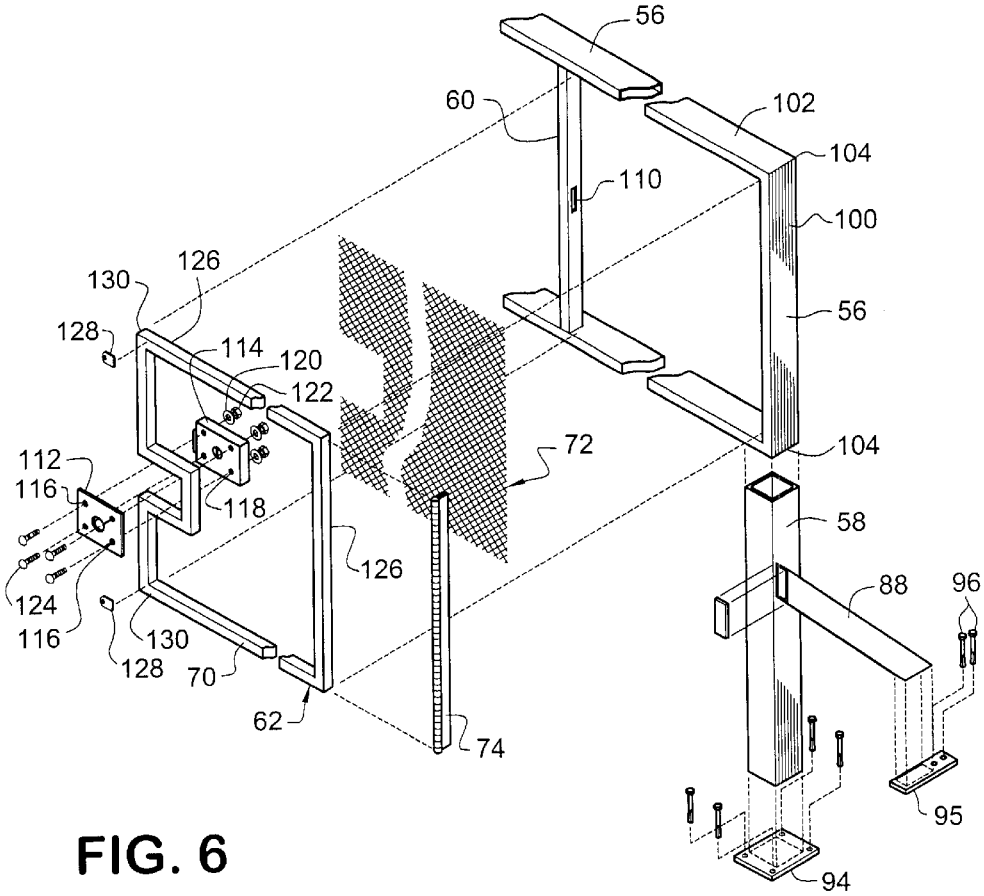
FIG. 6 is a perspective exploded view, illustrating the basic components of the cluster mailbox protective gate system according to a preferred embodiment of the present invention.

FIG. 6 is a perspective exploded view, partially in section, illustrating the basic components of the cluster mailbox protective gate system 50 according to a preferred embodiment of the present invention. A preferred method of making the protective gate system 50 is as follows:

Preferably, the cluster mailbox 52 or mailboxes are measured to determine what height and width dimensions are necessary to cover the rear doors 66 of the cluster mailbox 52 and enclose the exterior perimeter 76 (noted as a vertical dotted line in FIG. 3 and a horizontal dotted line in FIG. 5) of the cluster mailbox 52. Next, the exterior frame 56 is cut to length preferably utilizing one-inch by three-inch steel hollow metal tubing, as shown. Preferably, a rectangular-shaped frame is then assembled and connected with vertical members 100 and horizontal members 102, preferably by welding. Corners 104 may be butt-welded together but mitered corners are preferable. Under appropriate circumstances, other arrangements may suffice. Once the perimeter of the exterior frame 56 is welded, the posts 58 are welded to the bottom 86 of the exterior frame 56, as shown. Preferably, the bottom base plates 94 and 95 are pre-welded onto the respective posts 58 and support members 88 prior to assembly to the exterior frame 56. Preferably, a post 58 is placed and attached on each end 106 and 108 (see FIG. 1) of the protective gate 54, as shown, and additional posts 58 are placed about every four to six feet. The next step is preferably to install and attach the interior posts 60, which also comprise the door latch vertical members 110, followed by installation of the hinged doors 62. Preferably, the interior posts 60 are made from three-quarter-inch wide by one and one-half-inch thick hollow metal tubing, preferably steel. Under appropriate circumstances, other materials, for example, aluminum or strengthened plastics, may suffice. Preferably, the hinged doors 62 are pre-assembled, as shown. Preferably, the hinged doors 62 are formed from one-inch by one-inch square hollow metal tubing, preferably steel, preferably welded together. Preferably, hinge 74 is attached by welding as described above. The United States Postal Service utilizes special locks and has specific requirements for such locks. The present invention customizes a lock plate 112 to accommodate such USPO Locks or any lock required or requested by the user. Preferably, the lock plate 112 is about a four-inch by four and one-half-inch rectangular plate, as shown. Preferably, hole 116 locations are derived from matching up the (lock assembly 114) bolt holes 118 with the lock plate 112. Preferably, the lock assembly 114 is attached to the lock plate using bolts 124 and washers 120 and nuts 122, as shown. Preferably, the nuts 122 and washers 120 are located towards the cluster mailbox 52 to be more secure.

The next preferred step in the manufacture of the protective gate 54 is to attach the metal screening 72. Preferably, the metal screening 72 is attached by welding along the inner perimeter 126 of the hinged doors 62, as shown. Preferably, the metal screening is spot-welded about every inch along the inner perimeter 126. Next, stop tabs 128 are preferably welded to the outside portion 130 of the hinged door 62, as shown. The purpose of the stop tabs 128 is to keep the hinged doors 62 from hitting the rear doors 66 during operation. Under appropriate circumstances, other arrangements may suffice.

Figure 7:
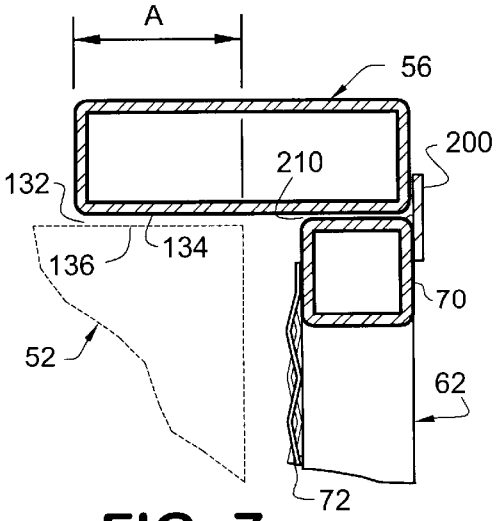
FIG. 7 is a sectional view through section 7—7 of FIG. 2.

FIG. 7 is a sectional view through section 7—7 of FIG. 2. FIG. 7 further illustrates the preferred connection and relative location of the exterior frame 56 as it encompasses the cluster mailbox 52. Steel outer frame 70 is also illustrated, as is the position of the metal screening 72. Preferably, there is a very small gap 132 between the bottom 134 of the exterior frame 56 and the top 136 of the cluster mailbox 52. The small gap 132 assists in preventing break-in of the cluster mailbox by limiting the tools (such as a crowbar) that can be slid into the gap 132. Under appropriate circumstances, other blocking arrangements may suffice.

Figure 8:
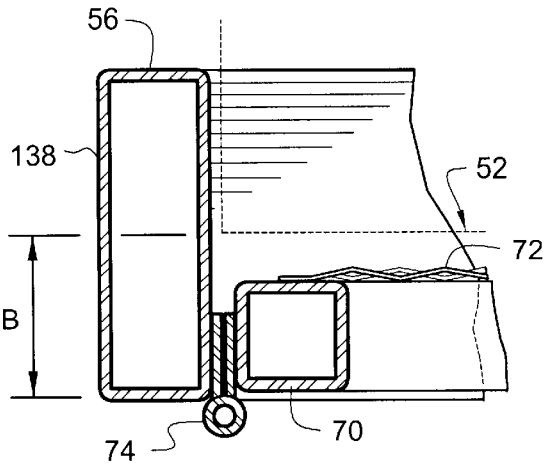
FIG. 8 is a sectional view through section 8—8 of FIG. 2.

FIG. 8 is a sectional view through section 8—8 of FIG. 2. FIG. 8 further illustrates the preferred positioning of one end 138 of the outer frame 70 and a hinged door as shown in FIG. 2. Preferably, distance B is the same as distance A, about two inches. Under appropriate circumstances, other distances may suffice.

Figure 9:
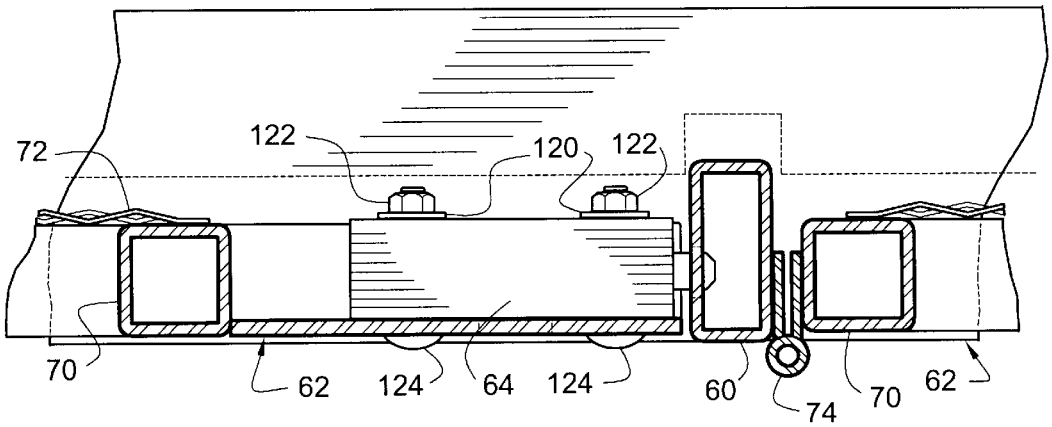
FIG. 9 is a sectional view through section 9—9 of FIG. 2.

FIG. 9 is a sectional view through section 9—9 of FIG. 2. FIG. 9 further illustrates a preferred arrangement of the framing components comprising the interior posts 60, hinged door 62, locking mechanism 64 and hinge 74.

Figure 10:
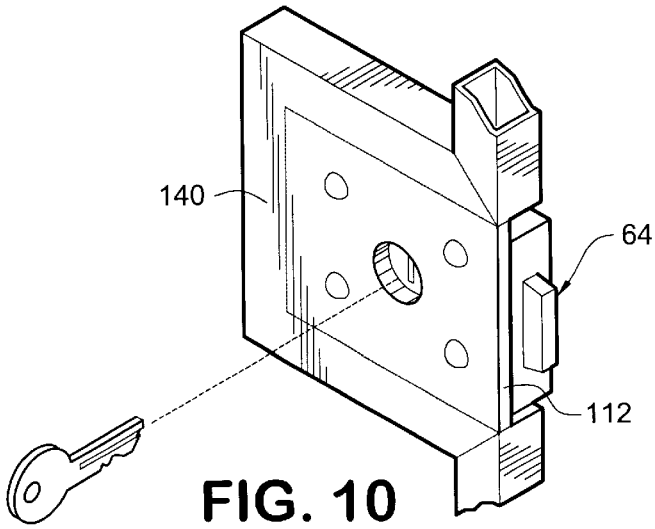
FIG. 10 is a partial perspective view of a locking mechanism of a hinged door of the cluster mailbox protective gate system according to a preferred embodiment of the present invention.

FIG. 10 is a perspective view, partially in section, of a locking mechanism 64 of hinged door 62 of the cluster mailbox protective gate system 50 according to a preferred embodiment of the present invention. FIG. 10 further illustrates a preferred embodiment of the locking mechanism 64 and preferred insertion into a steel frame 140, which covers 3 sides of the locking mechanism 64 and is preferably custom-built for each individual locking mechanism 64, as shown. Preferably, the lock 142 is installed last and the key 144 is typically provided with the lock. Both the lock 142 and the key 144 are preferably purchased from the Postal Authority (eg. USPO). This arrangement embodies herein wherein such at least one lock comprises at least one United States Postal Lock.

Figure 11:
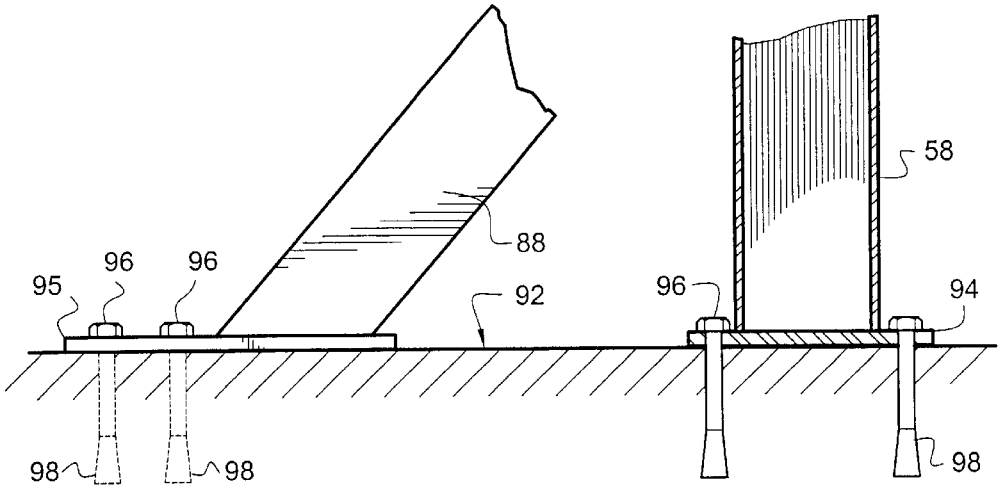
FIG. 11 is a partial side view, illustrating a preferred method of installing the ground supports of the cluster mailbox protective gate system according to a preferred embodiment of the present invention.

FIG. 11 is a side view, partially in section, illustrating a preferred method of installing the ground supports (posts 58 and support member 88) of the cluster mailbox protective gate system 50 according to a preferred embodiment of the present invention. Preferably, the posts 58 and support member 88 are attached to support surface 92, which is preferably concrete, utilizing concrete lag bolts 96 and expanding shields 98 as described above in FIG. 3 and as shown. Such use of concrete lag bolts 96 and expanding shields 98 for attachment of steel plate to concrete are well known in the prior art and under appropriate circumstances other attachment methods may suffice.

Figure 12:
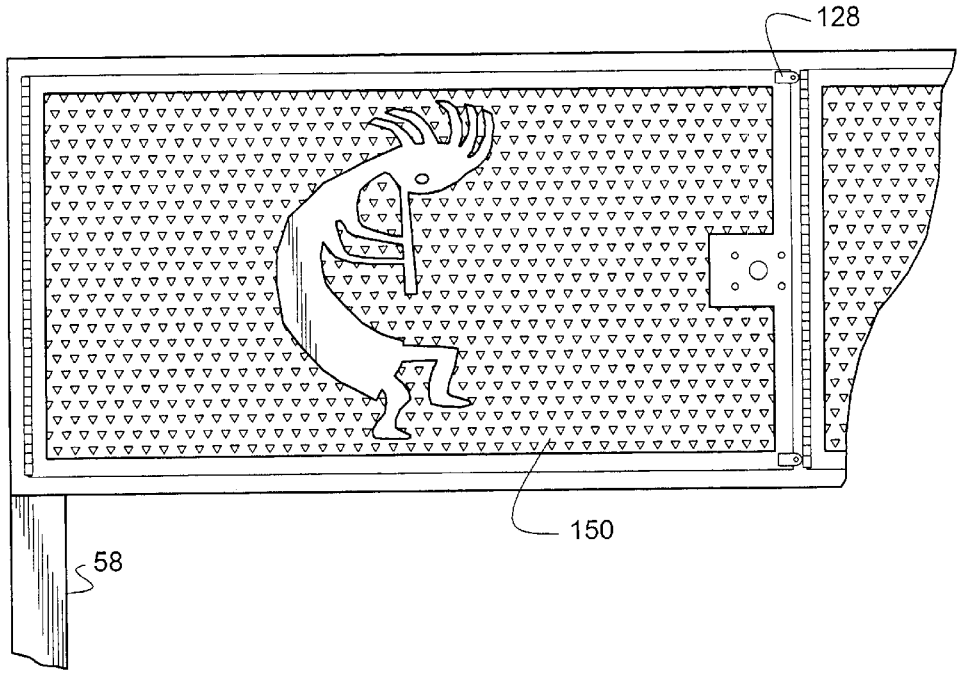
FIG. 12 is a front facing view of another preferred embodiment of the hinged door illustrating a decorative security screen.

FIG. 12 is a front facing view of another preferred embodiment of the hinged door 62 illustrating a decorative security screen 150. A variety of decorative screening 150 may be utilized on the hinged door 62 without detracting from the use of the cluster mailbox protective gate system 50 (embodying herein wherein such at least one screen portion comprises at least one decorative screen to decorate such at least one screen portion). Such screening is not necessary as other blocking may be used to prevent access to the cluster mailbox 52; however, screening as described above is preferred. Further, the use of other decorative accoutrements on the system 50 may be used under appropriate circumstances.

Figure 13:
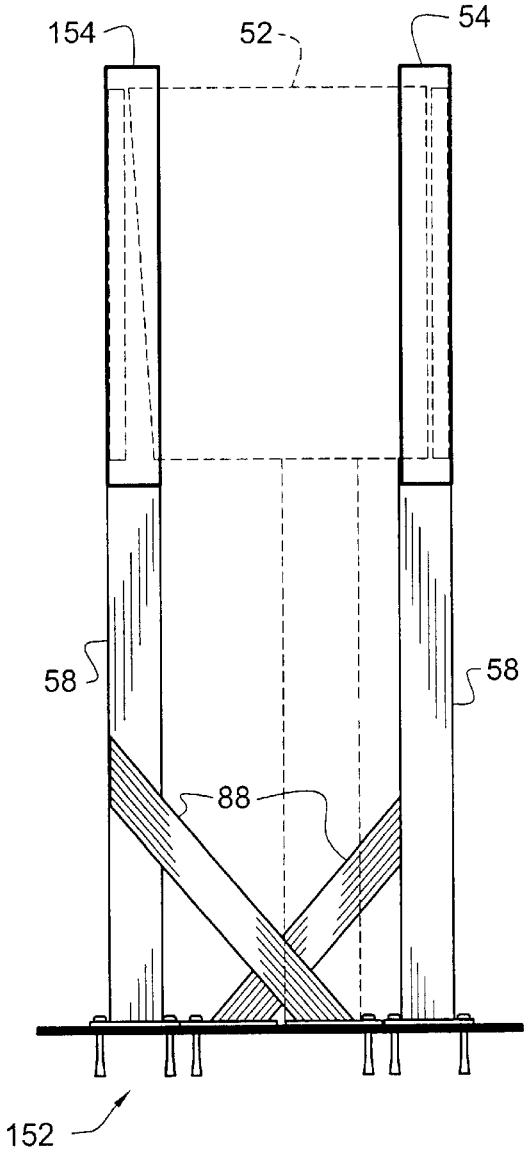
FIG. 13 is a side view of a cluster mailbox protective gate system according to an alternate preferred embodiment of the present invention.

FIG. 13 is a side view of the cluster mailbox protective gate system 152 according to an alternate preferred embodiment of the present invention. In locations where both the front and rear of cluster mailbox 52 are susceptible to vandalism, two gates 54 and 154 are utilized. Preferably, a front protective gate 154 (embodying herein wherein such at least one gate comprises at least one first gate frame having at least one first gate door comprising at least one first gate lock) similar to the protective gate 54. protects the rear (postman's door) of the cluster mailbox 52 (this arrangement embodies herein wherein such at least one gate comprises at least one second gate frame having at least one second gate door comprising at least one second gate lock; and, wherein such at least one first gate frame is structured and arranged to frame the at least one postman's access door; and, wherein such at least one first gate door is adapted to permit entry to the at least one postman's access door; and, wherein the at least one postman's access door is protected and may be selectively accessed by unlocking such at least one first gate lock). This arrangement also embodies at least one gate structured and arranged to protect entry to the at least one postman's access door and the plurality of individual mailboxes. Preferably, front protective gate 154 provides convenient locked selective access to the individual mailboxes located within the front of cluster mailbox 52 (embodying herein wherein such at least one second gate frame is structured and arranged to frame the plurality of individual mailboxes; and, wherein such at least one second gate door is adapted to permit entry to the plurality of individual mailboxes, and, wherein the plurality of individual mailboxes are protected and may be selectively accessed by unlocking such at least one second gate lock; and embodying wherein such at least one second gate lock is adapted to lock such at least one second gate door). Preferred construction means and materials essentially similar to the hinged door(s) 162 of front protective gate 154 are described, in general, in regards to gate 54 above. Preferably, door 162 comprises a hinge and a lock (embodying herein wherein such at least one first gate lock is adapted to lock such at least one first gate door) similar to door 62, however, the lock in door 162 is not necessarily a USPO lock but a lock that is preferably accessible by the mailbox users.

Figure 14:
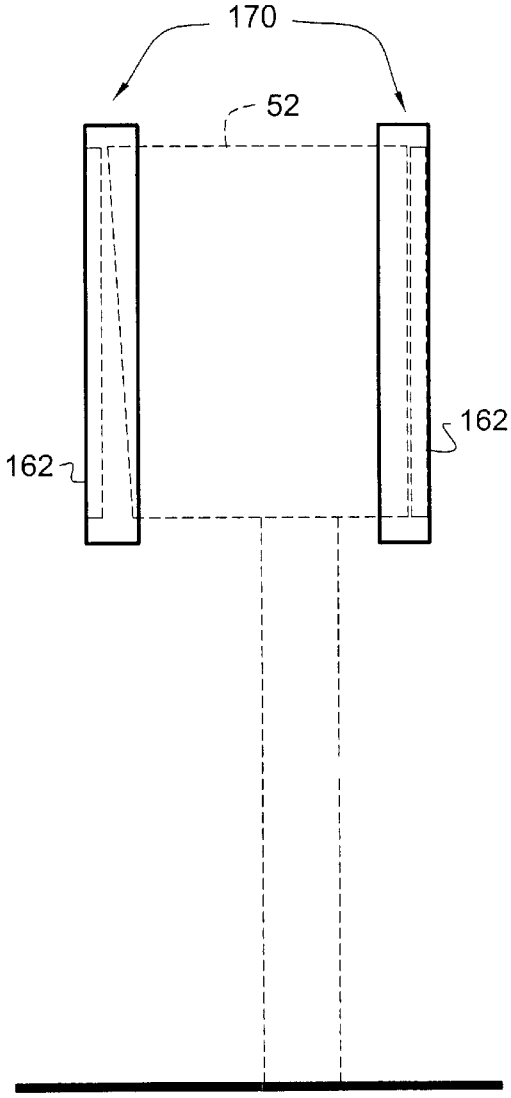
FIG. 14 is a side view of a cluster mailbox protective gate system according to another preferred embodiment of the present invention.

FIG. 14 is a side view of the cluster mailbox protective gate system 170 according to another preferred embodiment of the present invention. Under appropriate circumstances, protective gate system 170 may be installed on cluster mailbox 52 at the factory prior to shipping, as shown. Preferably, cluster mailbox protective gate system 170 is permanently mounted to cluster mailbox 52 using appropriate fasteners (e.g., bolts, screws, welding)(embodying herein at least one support to support such at least one gate). The double-sided gates of protective gate system 170 are preferably installed as a standard feature or, under appropriate circumstances, as an added option to a selected cluster mailbox 52. The use of additional ground support structures (such as posts 58) is generally not required, because cluster mailbox protective gate system 170 is directly supported by the cluster mailbox 52, as shown.

Figure 15:
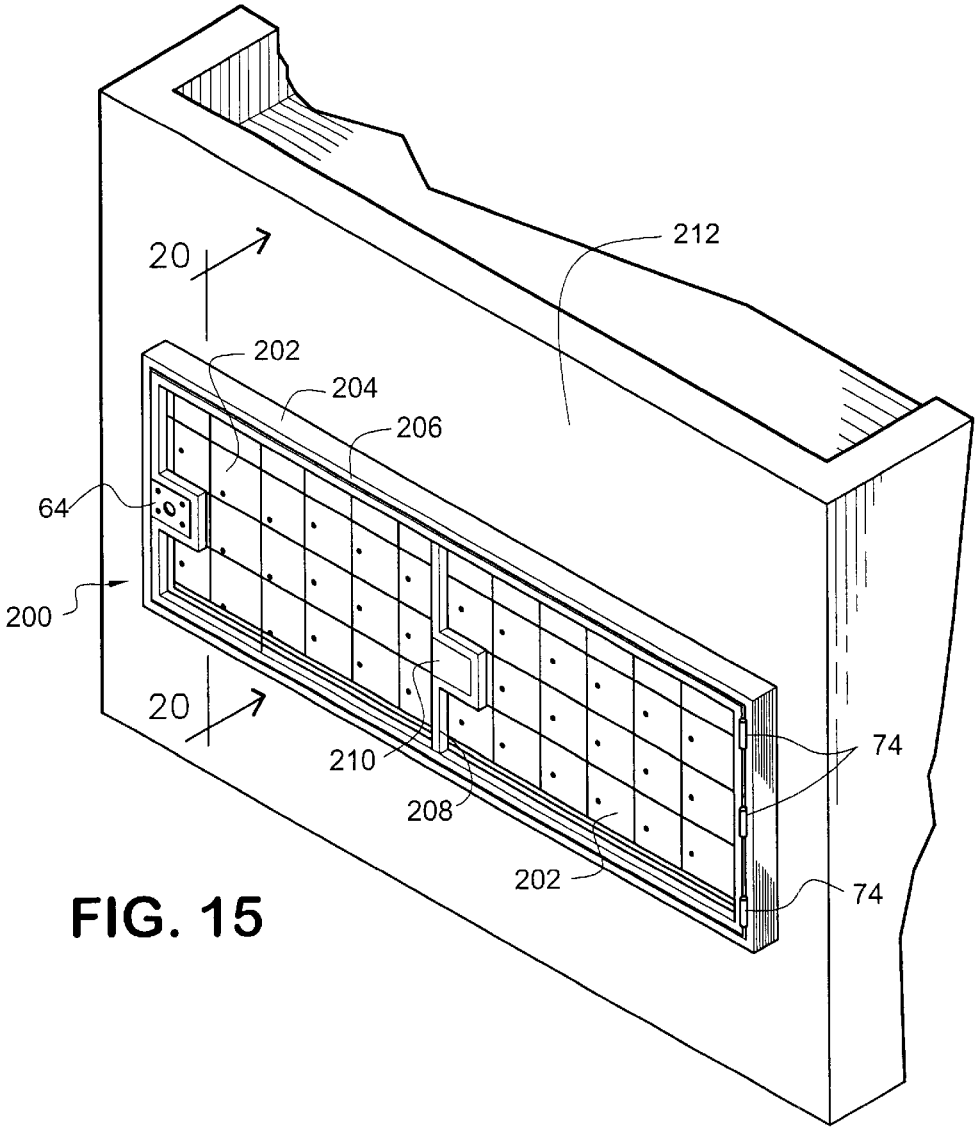
FIG. 15 is a perspective view of a cluster mailbox protective gate system installed over a wall mounted cluster mailbox according to yet another preferred embodiment of the present invention.

FIG. 15 is a perspective view of the cluster mailbox protective gate system 200 installed over wall mounted cluster mailbox 202 according to yet another preferred embodiment of the present invention. Preferably, cluster mailbox protective gate system 200 is composed of mounting frame 204, hinged door 206, locking mechanism 64, center protection assembly 208 (with blank protection plate 210) and hinge(s) 74, as shown. Cluster mailbox protective gate system 200 is preferably mounted to wall 212, as shown. Preferably, a mail delivery person may easily access the cluster mailbox 52 by unlocking the hinged door(s) 206 followed by unlocking, then accessing, cluster mailbox 52.

Figure 16:
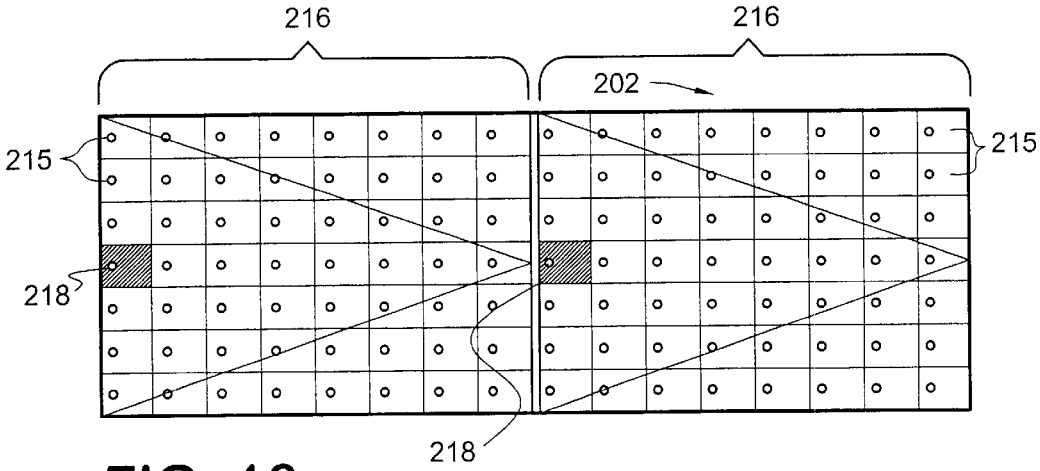
FIG. 16 is a front facing view of the wall mounted cluster mailbox illustration key features of a typical mailbox.

FIG. 16 is a front facing view of the wall mounted cluster mailbox 202 illustrating key features of a typical wall mounted cluster mailbox. Typically, wall mounted cluster mailbox 202 contains a grouping of mailboxes 214 having individually keyed doors 215 mounted within single larger hinged door 216, as shown. In the illustrated example of FIG. 16, two wall mounted cluster mailbox(es) 202 are shown mounted side-by-side, each having a grouping of 56 individually keyed doors 215, as shown. USPO keyed lock 218 (shown here within the shaded portion of wall mounted cluster mailbox 202) is used to secure a single larger hinged door 216 in a closed position. In typical operation, a USPO delivery person unlocks USPO keyed lock 218 to allow the single larger hinged door 216 and all individually keyed doors 215 of mailboxes 214 to simultaneously swing open, allowing direct access to the interior of mailboxes 214. This arrangement allows the USPO delivery person an efficient means for accessing and delivering the mail, however, as in prior examples, affords vandals quick access to the contents of wall mounted cluster mailbox 202. By forcing open USPO keyed lock 218 (using for example, a pry-bar or similar lever), vandals can easily access the interior of all mailboxes 214 serviced by single larger hinged door 216. It is highly preferred to provide additional physical protection to the vulnerable area surrounding the USPO keyed lock 218.

Figure 17:
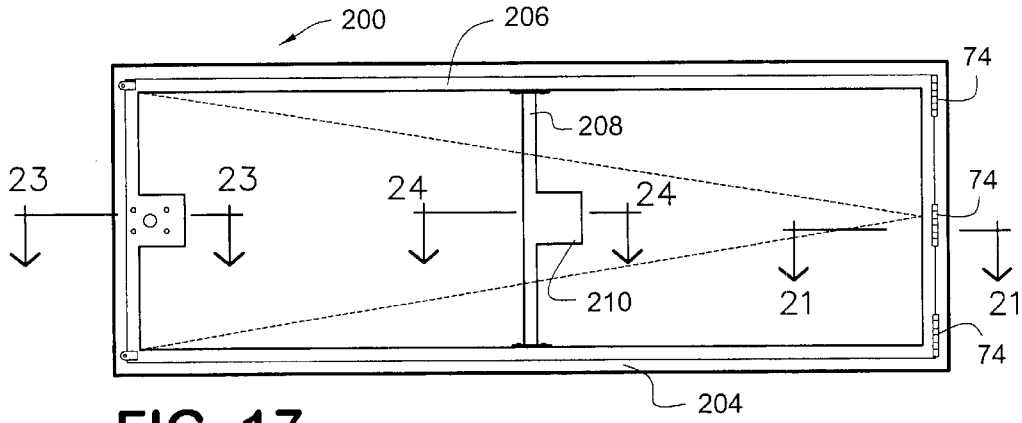
FIG. 17 is a front facing view of the cluster mailbox protective gate system according to FIG. 15.

FIG. 17 is a front facing view of the cluster mailbox protective gate system according to FIG. 15. Preferably, cluster mailbox protective gate system 200 provides an additional physical barrier that serves to block unauthorized access to USPO keyed lock 218. Cluster mailbox protective gate system 200 preferably includes locking mechanism 64 and center protection assembly 208, each positioned to cover and prevent unauthorized access to USPO keyed lock(s) 218, as shown. Preferably, locking mechanism 64 is essentially identical to the construction of the locking mechanism described in FIG. 6, FIG. 9 and FIG. 10 above. Preferably, center protection assembly 208 does not contain a lock, but includes a blank plate, as shown. It should be noted that the illustrated embodiment of FIG. 17 is configured to service two side-by-side wall mounted cluster mailbox(es) 202, however, under appropriate circumstances, other mailbox arrangements, such as single or multiple units, may be serviced by cluster mailbox protective gate system 200. In the protection of a single wall-mounted cluster mailbox 202 installation, center protection assembly 208 may be omitted. In the protection of a multi-wall-mounted cluster mailbox 202 installation, a plurality of center protection assembly(ies) 208 may be used to protect any or all additional USPO keyed lock(s) 218.

Figure 18:
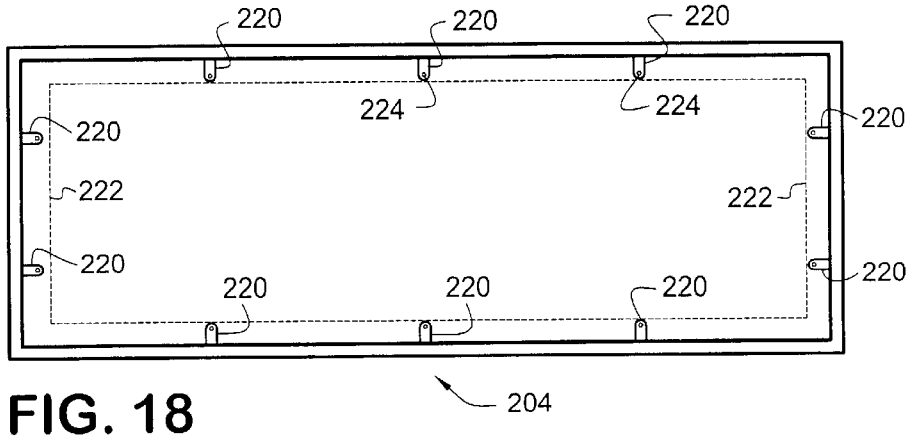
FIG. 18 is a front facing view of a mounting frame of the cluster mailbox protective gate system according to FIG. 15.

FIG. 18 is a front facing view of mounting frame 204 of the cluster mailbox protective gate system 200 according to FIG. 15. Preferably, mounting frame 204 is made of metal, preferably constructed of 1-½-inch square tubular steel. Mounting frame 204 is preferably welded to form a rigid support frame for the sub-assemblies of cluster mailbox protective gate system 200. Under appropriate circumstances, mounting frame 204 may be constructed of other durable materials, such as aluminum or rigid plastic, may be used in the construction of mounting frame 204. Fastener tabs 220, preferably constructed from ½-inch wide by ⅛-inch thick metal, preferably steel, are mounted, preferably by welding to mounting frame 204, as shown. The purpose of the fastener tabs 220 is to allow mounting frame 204 to be secured to wall 212 using fasteners appropriate to the construction of wall 212 (embodying herein wherein the accessible side is flush within a mounting wall and wherein such at least one first gate frame comprises attachment tabs adapted to attach such at least one first gate frame to the mounting wall). Fastener tabs 220 are preferably located at a spacing of about 24-inches on center, however, to accommodate specific installation factors such as composition and material strength of wall 212, other spacing arrangements may be used. The total preferred number of fastener tabs 220 used is typically dependant on the size of mounting frame 204. Preferably, fastener tabs 220 contain at least one aperture 224 to allow passage of the fastener, as shown. Under appropriate circumstances, mounting frame 204 may be mounted using other arrangements, such as welded rear-mounting studs set in epoxy filled sockets or direct bolting through the face of mounting frame 204. Preferably, mounting frame 204 and cluster mailbox protective gate system 200 is custom sized to a specific installation. Under appropriate circumstances, mounting frame 204 and cluster mailbox protective gate system 200 may preferably comprise a standardized line of prefabricated units sized to match popular commercially available wall mounted cluster mailbox systems. In each case, mounting frame 204 is sized to allow clear access to wall mounted cluster mailbox 202 (indicated by dashed line 222), while allowing fastener tabs 220 to be located in a position to provide solid fastener placement.

Figure 19:
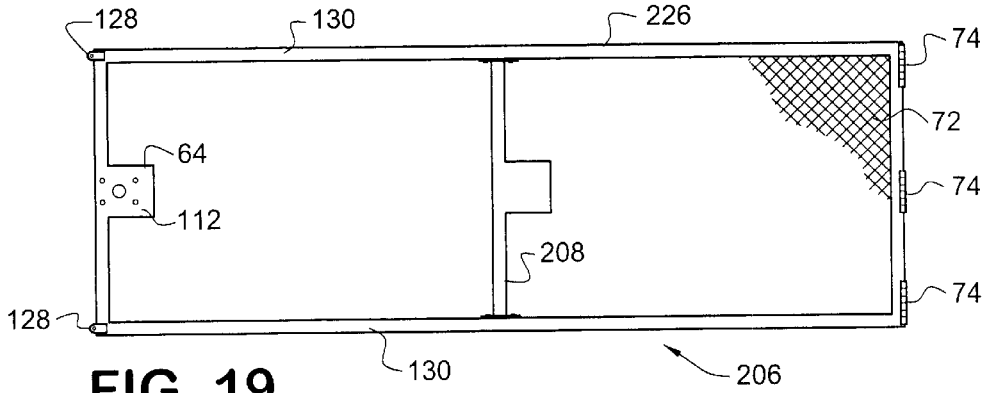
FIG. 19 is a front facing view of a hinged door of the cluster mailbox protective gate system according to FIG. 15.

FIG. 19 is a front facing view of hinged door 206 of the cluster mailbox protective gate system 200 according to FIG. 15. Preferably, the hinged door 206 is made of metal, preferably comprising frame 226, preferably fabricated from one-inch square tubular steel. Under appropriate circumstances, hinged door 206 can be fabricated from other durable and rigid materials, such as aluminum and plastic. The hinged door 206 is preferably attached to mounting frame 204 by at least one, preferably three hinge(s) 74. Preferably, hinge 74 is a metal butt-type hinge, preferably constructed from type 304 stainless-steel. Under appropriate circumstances, other hinge types, including continuous hinges, may suffice. Preferably, center protection assembly 208 is positioned to cover USPO keyed lock 218 and is permanently mounted to the upper and lower interior portions of frame 226, as shown. Locking mechanism 64 is also preferably positioned to protect USPO keyed lock 218, as shown. Stop tabs 128 are preferably welded to the outside portion 130 of the hinged door 206, as shown. The purpose of the stop tabs 128 is to keep the hinged doors 206 from hitting the front of wall mounted cluster mailbox 202 during operation. Under appropriate circumstances, other arrangements to control movement of hinged doors 206, such as extension of the lock plate 112, may suffice.

Under appropriate circumstances, although less preferred, metal screening 72 may be supplied within the frame 226 to provide protection to the individually keyed doors 215 of wall mounted cluster mailbox 202. When metal screening 72 is used, USPO keyed lock 218 is preferably master keyed (a master key held by the mail delivery person opens all the locks in the system, while each of the individually keyed doors 215 has its own unique key, opening only the individual mail box and hinged door 206).

Metal screening 72 is preferably ¾-inch 9-guage expanded metal screen. Preferably, the metal screening 72 is welded to frame 226, preferably using puddle welds (or other well-known welding methods) located about every inch around the perimeter of the metal screening 72.

Figure 20:
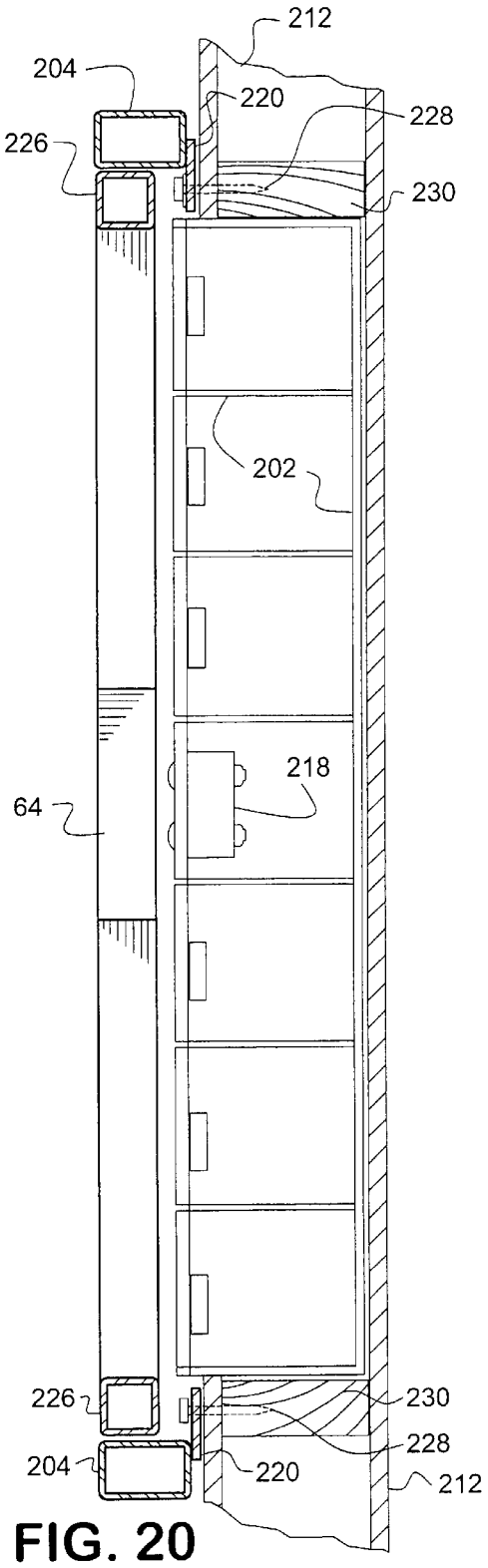
FIG. 20 is a view through section 20—20 of the cluster mailbox protective gate system of FIG. 15.

FIG. 20 is a view through section 20—20 of the cluster mailbox protective gate system 200 of FIG. 15. FIG. 20 illustrates the preferred mounting arrange of cluster mailbox protective gate system 200 over wall mounted cluster mailbox 202. Fastener tabs 220 of mounting frame 204 are shown with fasteners 228 (in the illustrated example lag screws) anchored to the surrounding structure 230 of wall 212, as shown. Frame 226 of hinged door 206 is preferably positioned within mounting frame 204, as shown. The preferred position of locking mechanism 64 centrally located over USPO keyed lock 218 is clearly illustrated in FIG. 20.

Figure 21:
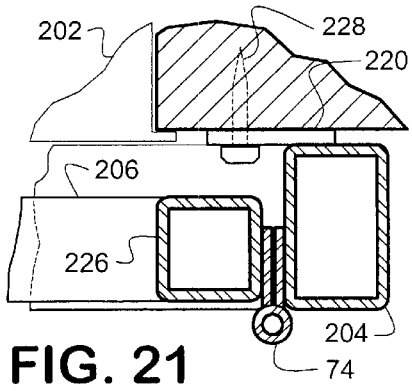
FIG. 21 is a view through section 21—21 of the cluster mailbox protective gate system of FIG. 17.

FIG. 21 is a view through section 21—21 of the cluster mailbox protective gate system 200 of FIG. 17. Preferably, hinge 74 is attached, preferably by welding, to both the outer frame 226 of hinged door 206 and mounting frame 204, as shown (embodying herein wherein such at least one first gate door comprises at least one first gate door hinge). Preferably, fasteners 228 of fastener tabs 220 are inaccessible to vandals when hinged door 206 is in a closed position, as shown.

Figure 22:
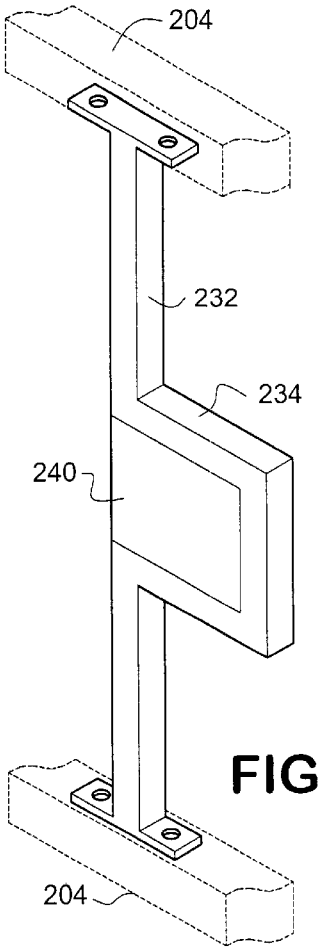
FIG. 22 is a perspective view of a center protection assembly of the cluster mailbox protective gate system of FIG. 15.

FIG. 22 is a perspective view of the center protection assembly 208 of the cluster mailbox protective gate system 200 of FIG. 15. Preferably, center protection assembly 208 includes as a subassembly adjustable frame 232 made of metal, preferably fabricated from one-inch square tubular steel. Secondary steel frame 234, preferably fabricated from one-inch square tubular steel, is preferably welded to adjustable frame 232, as shown. Adjustment tabs 236 are preferably 1-inch wide×⅛-inch thick steel are preferably welded to the upper and lower end of adjustable frame 232, as shown. Each adjustment tab(s) 236 is preferably provided with at least one, preferably two, mounting holes 238 to allow center protection assembly 208 to be attached, preferably bolted to hinged door 206 after verification of field measurements. Under appropriate circumstances, center protection assembly 208 may be mounted to hinged door 206 using other typical means, such as welding. Preferably, blank plate 240 is mounted to secondary steel frame 234, preferably by welding, as shown. Blank plate 240 is preferably a ⅛-inch thick steel plate of a size appropriate to the specific wall mounted cluster mailbox 202.

Figure 23:
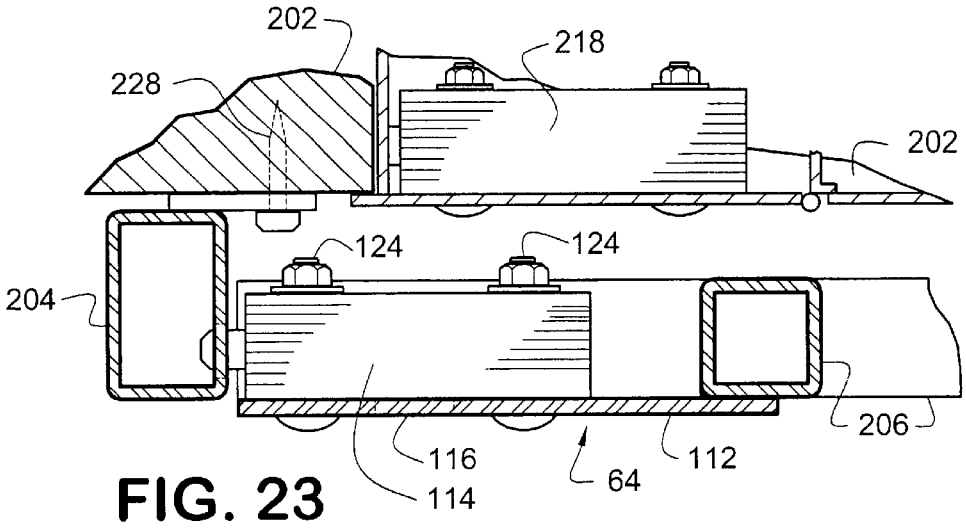
FIG. 23 is a view through section 23—23 of the cluster mailbox protective gate system of FIG. 17.

FIG. 23 is a view through section 23—23 of the cluster mailbox protective gate system 200 of FIG. 17. The preferred position of locking mechanism 64 centrally located over USPO keyed lock 218 (located within wall mounted cluster mailbox 202) is again illustrated in FIG. 23. Most preferably, cluster mailbox protective gate system 200 is designed such that locking mechanism 64 receives a lock assembly 114 identical to the USPO keyed lock 218 located in wall mounted cluster mailbox 202 (embodying herein wherein such at least one first lock comprises at least one United States Postal Lock). As in the described locking mechanism 64 of FIG. 6, the lock plate 112 is preferably about a four-inch by four and one-half-inch rectangular plate, as shown. Preferably, hole 116 locations are derived from matching up the lock assembly 114, and bolt-holes 118, with the lock plate 112. Preferably, the lock assembly 114 is attached to the lock plate using bolts 124, as shown. In light of the teaching herein, those knowledgeable in such attachment art, may, under appropriate circumstances, utilize other arrangements.

Figure 24:
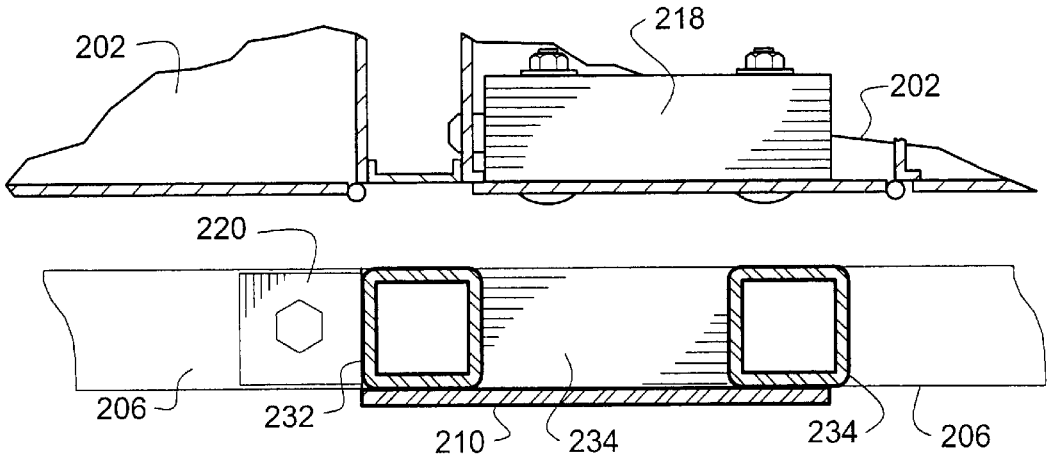
FIG. 24 is a view through section 24—24 of the cluster mailbox protective gate system of FIG. 17.

FIG. 24 is a view through section 24—24 of the cluster mailbox protective gate system 200 of FIG. 17. The preferred position of center protection assembly 208 located over USPO keyed lock 218 is illustrated in FIG. 24. Preferably, blank protection plate 210 is welded to adjustable frame 232 and secondary steel frame 234, as shown. A portion of fastener tab(s) 220 is visible, preferably anchored to hinged door 206, as shown.

Figure 25:
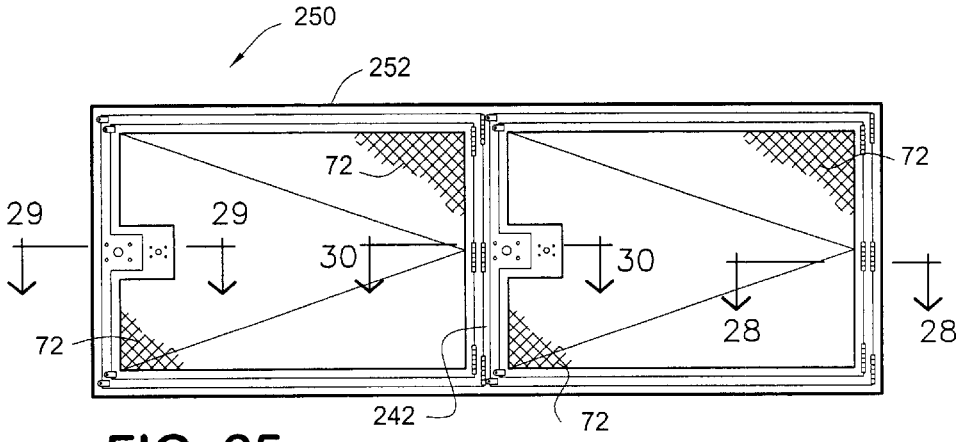
FIG. 25 is a front facing view of a cluster mailbox protective gate system for a wall mounted cluster mailbox according to an alternate preferred embodiment of the present invention.

FIG. 25 is a front facing view of the cluster mailbox protective gate system 250 for wall mounted cluster mailbox 202 (similar to that illustrated in FIG. 16) according to an alternate preferred embodiment of the present invention. Preferably, cluster mailbox protective gate system 250 is used in installations requiring protection of the individually keyed doors 215 of wall mounted cluster mailbox 202 in addition to the postman's access door (see FIG. 16). A nested set of doors comprising outer-hinged door 254 (embodying herein wherein such at least one gate comprises at least one first gate frame having at least one first gate door comprising at least one first gate lock) and inner-hinged door 256 (embodying herein wherein such at least one gate comprises at least one second gate frame having at least one second gate door comprising at least one second gate lock) are positioned within mounting frame 252, as shown.

Preferably, mounting frame 252 is essentially identical in construction to mounting frame 204 of FIG. 18, with the exception that mounting frame 252 preferably uses one or more vertical steel tube center post(s) 258, permanently mounted, preferably by welding, to upper and lower horizontal steel tubes of mounting frame 252, as shown. Tube center post 258 is preferably a 1-½ inch steel tube and serves as a hinge mounting point and strike for outer-hinged door(s) 254, as shown. Under appropriate circumstances, other durable materials, such as aluminum or rigid plastic, may be used in the construction of mounting frame 252.

Figure 26:
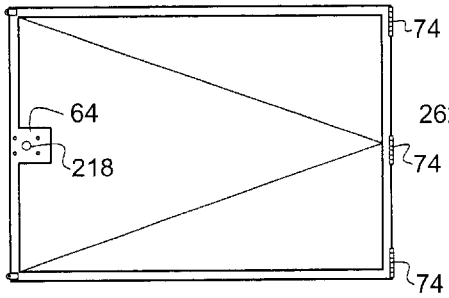
FIG. 26 is a front facing view of an outer-hinged door of the cluster mailbox protective gate system according to FIG. 25.

FIG. 26 is a front facing view of outer-hinged door 254 of the cluster mailbox protective gate 250 according to FIG. 25. Construction and arrangements of outer-hinged door 254 are essentially identical to those of hinged door 206 of FIG. 19 above.

Figure 27:
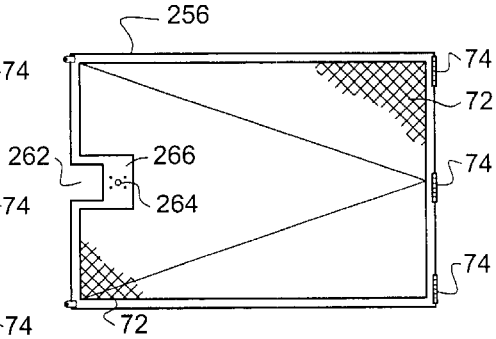
FIG. 27 is a front facing view of an inner-hinged door of the cluster mailbox protective gate system according to FIG. 25.

FIG. 27 is a front facing view of an inner-hinged door 256 of the cluster mailbox protective gate system 250 according to FIG. 25. Inner-hinged door 256 is preferably sized to nest within outer-hinged door 254, as shown (This arrangement embodies wherein such at least one second gate frame is nested within such at least one first gate frame). Preferably, inner-hinged door 256 (embodying herein such at least one second gate door comprises at least one second gate door hinge) is made of metal, preferably 1-inch square tubular steel. Locking mechanism 260 is preferably adapted to fit over locking mechanism 64 of outer-hinged door 254 by utilizing complementary notch 262, as shown. Preferably, locking mechanism 260 uses lock assembly 264 keyed independently from USPO keyed lock 218 and individually keyed doors 215 (embodying herein wherein such at least one second gate lock is adapted to lock such at least one second gate door). As those skilled in the art will now appreciate, other lock and keying arrangements may suffice, under appropriate circumstances. Metal screening 72 is preferably supplied within inner-hinged door 256 to provide protection to the individually keyed doors 215 of wall mounted cluster mailbox 202 (embodying herein wherein such at least one second gate door comprises at least one screen portion). As in previous embodiments, metal-screening 72 is preferably a ¾-inch 9-guage expanded metal screen. Under appropriate circumstances, to meet functional specific or aesthetic requirements, other screen materials may suffice. For example decorative screening may also be used and is preferred for assisting in matching neighboring decor (embodying herein wherein such at least one screen portion comprises at least one decorative screen to decorate such at least one screen portion). Preferably, metal-screening 72 is welded to inner-hinged door 256, preferably using puddle welds (or other well-known welding methods) located about every inch around the perimeter of the metal screening 72. In operation, a mail delivery person accesses the cluster mailbox by unlocking and swinging away outer-hinged door 254 (with nested inner-hinged door 256 attached). This arrangement embodies herein wherein the at least one postman's access door is protected and may be selectively accessed by unlocking such at least one first gate lock. An individual mailbox user accesses the mailbox by unlocking and swinging away inner-hinged door 256 (leaving outer-hinged door 254 in place). This arrangement embodies herein wherein the plurality of individual mailboxes are protected and may be selectively accessed by unlocking such at least one second gate lock. Inner-hinged door 256 is preferably sized to provide full access to the mailbox when open.

Figure 28:
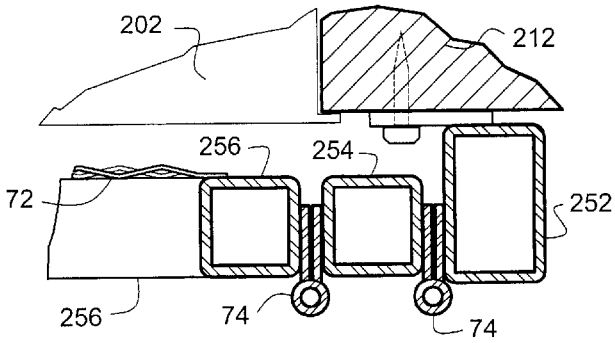
FIG. 28 is a view through section 28—28 of the cluster mailbox protective gate system of FIG. 25.

FIG. 28 is a view through section 28—28 of the cluster mailbox protective gate system of FIG. 25. Attachment of mounting frame 252 to wall 212 is essentially identical to that described in FIG. 21. Preferably, mounting frame 252 provides a welded attachment point for at least one, preferably three hinge(s) 74, which are preferably welded to outer-hinged door 254, as shown. Preferably, a second set of hinge(s) 74 are welded between outer-hinged door 254 and inner-hinged door 256, as shown.

Figure 29:
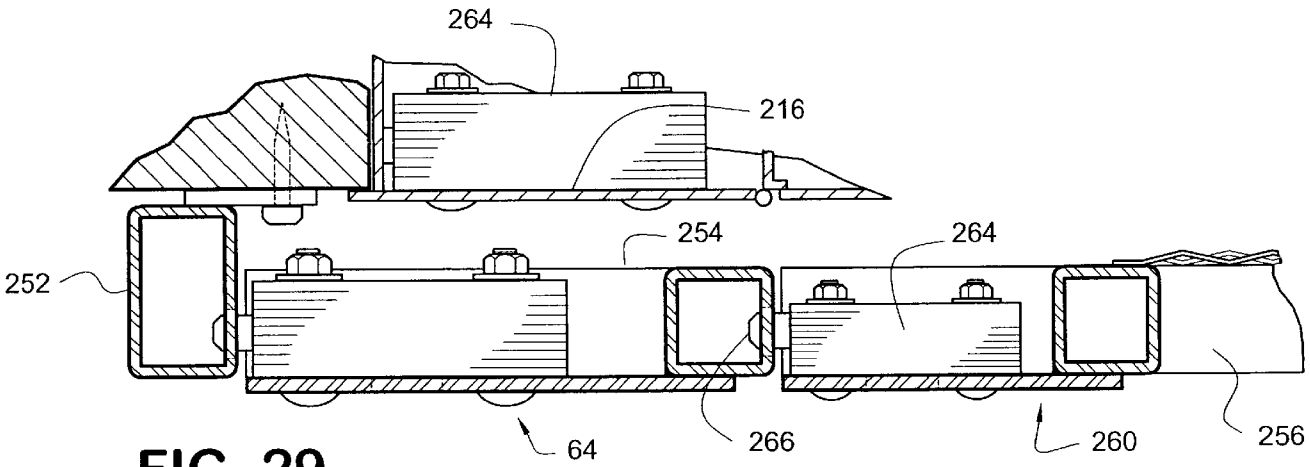
FIG. 29 is a view through section 29—29 of the cluster mailbox protective gate system of FIG. 25.

FIG. 29 is a view through section 29—29 of the cluster mailbox protective gate system 250 of FIG. 25. Preferably, bolt 266 of lock assembly 264 engages the locking mechanism 64 of outer-hinged door 254, thereby preventing the movement of inner-hinged door 256 relative to outer-hinged door 254. Similarly, bolt 266 of USPO keyed lock 218 engages the vertical tube of mounting frame 252, thereby preventing the movement of both outer-hinged door 254 and inner-hinged door 256 (when inner-hinged door 256 is locked), as shown. Preferred positioning of the locked outer-hinged door 254 prevents opening of the single larger hinged door 216 of wall mounted cluster mailbox 202, even when inner-hinged door 256 is unlocked and open, as shown.

Figure 30:
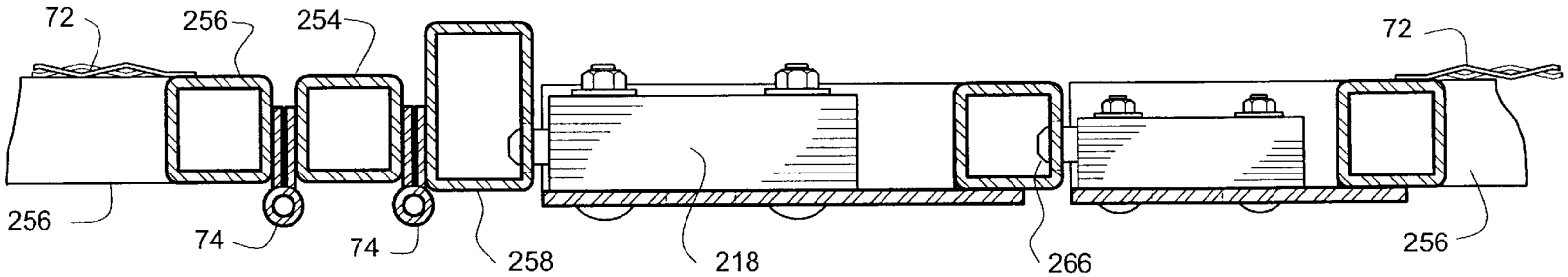
FIG. 30 is a view through section 30—30 of the cluster mailbox protective gate system of FIG. 25.

FIG. 30 is a view through section 30—30 of the cluster mailbox protective gate system 250 of FIG. 25. The preferred arrangement of assemblies adjacent to and engaging tube center post(s) 258 is illustrated in FIG. 30. The functional operation of outer-hinged door 254 and inner-hinged door 256 at tube center post(s) 258 is essentially similar to that described in FIG. 28 and FIG. 29 with the following variations; center post(s) 258 provides a welded attachment point for hinge(s) 74, which are preferably welded to outer-hinged door 254; and bolt 266 of USPO keyed lock 218 engages the vertical tube of tube center post(s) 258, as shown.

In further reference to FIG. 2 and FIG. 7, under appropriate circumstances, such as to provide increased security and additional resistance to unauthorized access, the steel outer frame 70 preferably includes a protective perimeter edge plate 200 (as indicated by the dashed lines). Perimeter edge plate 200 is preferably adapted to prevent a vandal from introducing a pry bar or similar implement between the steel outer frame 70 and exterior frame 56. Preferably, perimeter edge plate 200 is welded to the outer face 202 of the steel outer frame 70 (as illustrated in FIG. 7) continuously along the top 204, bottom 206 and strike side 208 of hinged doors 62, as shown. Preferably, edge protective plate 200 comprises a ½" wide by ⅛" thick steel plate centered over door gap 210, as shown.

Although applicant has described applicant's preferred embodiments of this invention, it will be understood that the broadest scope of this invention includes a system including each and every novel detail, feature, article, process, system and/or method disclosed in or mentioned by or shown in this specification, including the drawings, the claims, the abstract, and any appendices.

What is claimed is:

1. A protective gate system for at least one cluster mailbox having a first side comprising at least one postman's access door and a second side comprising a plurality of individual mailboxes, comprising, in combination:

a) at least one gate structured and arranged to protect entry to the at least one postman's access door and the plurality of individual mailboxes; and b) at least one support to support said at least one gate;

c) wherein said at least one gate comprises at least one first gate frame having at least one first gate door comprising at least one first gate lock;

d) wherein said at least one gate comprises at least one second gate frame having at least one second gate door comprising at least one second gate lock;

e) wherein said at least one first gate frame is structured and arranged to frame the at least one postman's access door;

f) wherein said at least one second gate frame is structured and arranged to frame the plurality of individual mailboxes;

g) wherein said at least one first gate door is adapted to permit entry to the at least one postman's access door;

h) wherein said at least one second gate door is adapted to permit entry to the plurality of individual mailboxes;

i) wherein said at least one first gate lock is adapted to lock said at least one first gate door;

j) wherein said at least one second gate lock is adapted to lock said at least one second gate door;

k) wherein the at least one postman's access door is protected and may be selectively accessed by unlocking said at least one first gate lock; and l) wherein the plurality of individual mailboxes are protected and may be selectively accessed by unlocking said at least one second gate lock.

2. The protective gate system according to claim 1 wherein:

a) said at least one first gate door comprises at least one first gate door hinge; and b) said at least one second gate door comprises at least one second gate door hinge.

3. The protective gate system according to claim 1 wherein said at least one first gate door comprises at least one screen portion.

4. The protective gate system according to claim 1 wherein said at least one second gate door comprises at least one screen portion.

5. The protective gate system according to claim 3 wherein said at least one second gate door comprises at least one screen portion.

6. The protective gate system according to claim 5 wherein said at least one screen portion comprises at least one decorative screen to decorate said at least one screen portion.

7. The protective gate system according to claim 1 wherein said at least one first lock comprises at least one United States Postal Lock.

8. The protective gate system according to claim 5 wherein said at least one screen portion comprises 9-guage expanded metal.

9. A protective gate system for a cluster mailbox, having only one accessible side, comprising at least one postman's access door and at least one mailbox located on the accessible side, comprising, in combination:

a) at least one gate structured and arranged to protect entry to the at least one postman's access door and the plurality of individual mailboxes; and b) at least one support to support said at least one gate;

c) wherein said at least one gate comprises at least one first gate frame having at least one first gate door comprising at least one first gate lock;

d) wherein said at least one gate comprises at least one second gate frame having at least one second gate door comprising at least one second gate lock;

e) wherein said at least one second gate frame is nested within said at least one first gate frame;

f) wherein said at least one first gate frame is structured and arranged to frame the at least one postman's access door;

g) wherein said at least one second gate frame is structured and arranged to frame the plurality of individual mailboxes;

h) wherein said at least one first gate door is adapted to permit entry to the at least one postman's access door;

i) wherein said at least one second gate door is adapted to permit entry to the plurality of individual mailboxes;

j) wherein said at least one first gate lock is adapted to lock said at least one first gate door;

k) wherein said at least one second gate lock is adapted to lock said at least one second gate door;

l) wherein the at least one postman's access door is protected and may be selectively accessed by unlocking said at least one first gate lock; and m) wherein the plurality of individual mailboxes are protected and may be selectively accessed by unlocking said at least one second gate lock.

10. The protective gate system according to claim 9 wherein:

a) said at least one first gate door comprises at least one first gate door hinge; and b) said at least one second gate door comprises at least one second gate door hinge.

11. The protective gate system according to claim 9 wherein said at least one second gate door comprises at least one screen portion.

12. The protective gate system according to claim 1 wherein said at least one screen portion comprises at least one decorative screen to decorate said at least one screen portion.

13. The protective gate system according to claim 9 wherein said at least one first lock comprises at least one United States Postal Lock.

14. The protective gate system according to claim 11 wherein said at least one screen portion comprises 9-guage expanded metal.

15. The protective gate system according to claim 9 wherein the accessible side is flush within a mounting wall and wherein said at least one first gate frame comprises attachment tabs adapted to attach said at least one first gate frame to the mounting wall.

* * * * *

UNITED STATES PATENT AND TRADEMARK OFFICE

CERTIFICATE OF CORRECTION

PATENT NO. : 6,749,109 B2
DATED : June 15, 2004
INVENTOR(S) : Hill

It is certified that error appears in the above-identified patent and that said Letters Patent is hereby corrected as shown below:

Column 17,
Line 4, "claim 1" should read -- claim 11 --.

Signed and Sealed this

Twenty-second Day of February, 2005

JON W. DUDAS
*Director of the United States Patent and Trademark Office*